United States Patent [19]

Buttner

[11] 4,371,032

[45] Feb. 1, 1983

[54] HEAT TRANSFER SYSTEM

[76] Inventor: Horace J. Buttner, 1501 Palos Verdes Dr., N. #127, Harbor City, Calif. 90710

[21] Appl. No.: 219,022

[22] Filed: Dec. 22, 1980

[51] Int. Cl.[3] ..... F28D 11/02; F28G 15/04

[52] U.S. Cl. ..... 165/91; 165/87; 165/94

[58] Field of Search ..... 165/91, 94, 87, 95

[56] References Cited

U.S. PATENT DOCUMENTS 2,838,780 6/1958 Kean ..... 165/94 X 3,216,271 11/1965 Erdmenger ..... 165/87 X 3,255,814 6/1966 Zimmermann et al. ..... 165/87

3,628,602 12/1971 Brunner ..... 165/94 X 3,775,041 11/1973 Buttner ..... 165/104.34 X

*Primary Examiner*—Sheldon J. Richter

*Attorney, Agent, or Firm*—Pollock, Vande Sande & Priddy

[57] ABSTRACT

An improved heat transfer system of the helical screw type, including endless loop guided volute passage driven scraping means for continuously cleaning the helical screw heat transfer member to prevent the build-up of workable material on an outer surface of the helical screw, while at the same time minimizing the power necessary for rotating the helical screw.

25 Claims, 8 Drawing Figures

FIG. 3
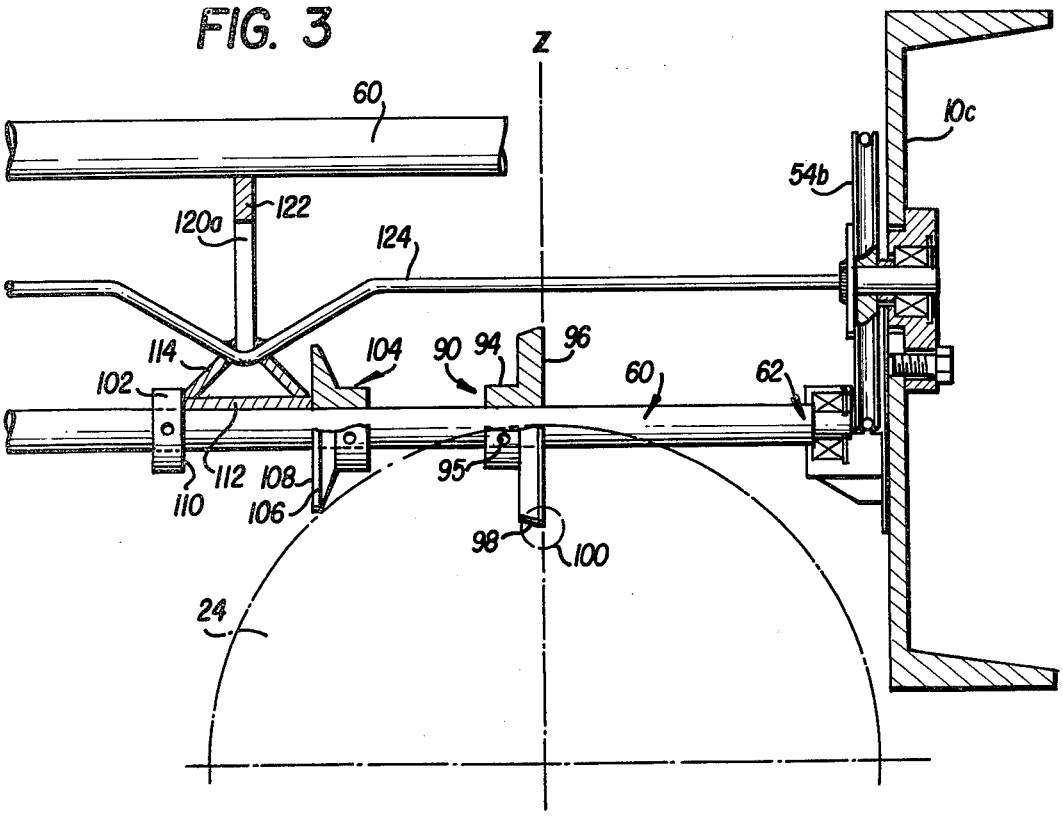
FIG. 4A
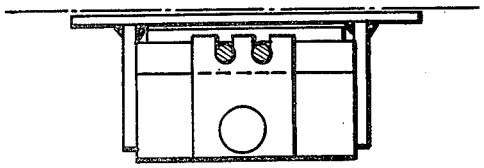
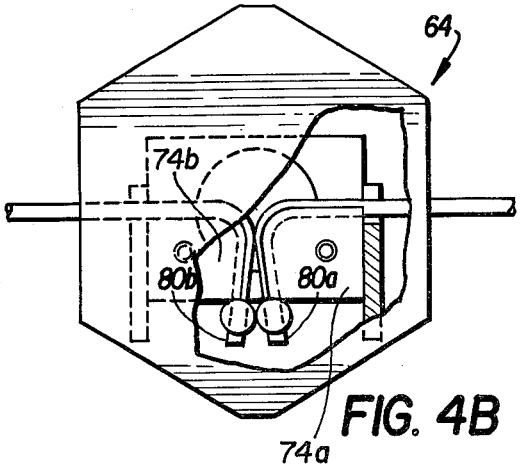
FIG. 4B
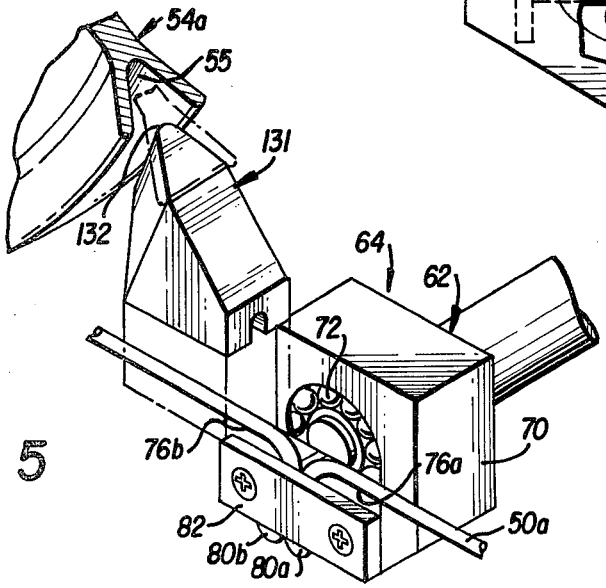
FIG. 5

HEAT TRANSFER SYSTEM

DESCRIPTION

Cross-Reference to Related Applications

The present invention relates to an improved heat transfer system of the helical screw type generally disclosed in U.S. Pat. No. 3,775,041 issued Nov. 27, 1973 to Horace Judson Buttner who is also an inventor of the present invention. It is respectfully requested that the subject matter of U.S. Pat. No. 3,775,041 be incorporated into the present application by express reference thereto.

Technical Field

The present invention relates to an improved heat transfer system including a rotatable mixing member and further including endless loop guided volute passage driven scraping means for preventing the build-up of workable material on the outer surface of the mixing member.

Background Art

During processing of many workable materials having fluent, wet or even pasty characteristics, it is often considered desirable to separate volatile matter from the workable material by evaporation if possible. In order to accomplish such a separation step, the workable material is brought into contact with hot gases which dry the material and evaporate the volatile matter. A major problem associated with drying such workable materials is a general inability to achieve substantially uniform drying while minimizing the amount of hot gas employed to achieve evaporation.

As discussed in the referred-to U.S. Pat. No. 3,775,041, helical screw-type heat transfer devices can be employed for conveying heat to a workable material as the material is mixed by rotation of the screw. This indirect heating of the workable material avoids the need for large quantities of hot gases necessary for directly heating and drying the material. In addition, the rotating action of the helical screw acts to mix the workable material and thereby ensure substantially uniform drying of the entire amount of workable material present. This is desirable in reducing the need for performing additional after-treatment steps often required in conventional dryers to separate volatile matter remaining in unheated portions of the workable material. While helical screw-type heat transfer apparatus can often efficiently dry workable material, such devices are subject to certain drawbacks which seriously diminish their usefulness. In particular, helical screw devices can easily become clogged with workable material, leading to a build-up of carbonaceous deposits on the screw surfaces. Such deposits impede the flow of heat between the screw and the workable material.

In an effort to overcome problems associated with clogging and build-up of deposits on the screw surface, a variety of cleaning devices have been suggested for intermittently or continuously cleaning the screw surface. For example, it has been suggested that a plurality of screws be precisely mated to inter-mesh and clean one another. Such structures are costly to build due to the precision mating of the screws and, more importantly, such multiple inter-meshing screws can easily bind due to build-up of deposits on the screw surface or even due to uneven thermal expansion of the screws. In order to overcome these kinds of problems, U.S. Pat. No. 3,775,041 suggests that a plurality of separate spherical balls be periodically circulated into contact with a volute passageway at an upstream portion of the helical screw. Because the balls maintain rolling or sliding contact with the volute passageway as they move downstream, they effectively scrub clean the surface of the helical screw. As the balls reach the downstream end of the screw, they are conveyed through a recirculation passageway to the upstream end to begin another cleaning cycle. While the balls proved completely successful in accomplishing their intended function, several unexpected problems arose which made unacceptably high the power requirements for rotating the screw. In particular, it was noted that workable material tended to clog up at the return entry into the recirculation passageway and it was guessed that additional clogging could be taking place within the return passageway itself. In order to drive the balls through and break up these clogs of workable material, it became necessary to supply additional rotating torque to the helical screw. Furthermore, solid matter present in the workable material often tended to inhibit movement of the balls, thereby further increasing the power requirements. Finally, the normal friction generated between a large plurality of balls and the volute passageway also tended to significantly increase the required operating torque.

As will become clear hereafter, the present invention provides an assembly which overcomes the referred-to problems confronting known prior art assemblies, while at the same time effectively cleaning the outer surface of a rotating heat transfer member to prevent the build-up of deposits on the heat transfer member during normal operation.

DESCRIPTION OF THE INVENTION

According to the present invention, an improved heat transfer system includes endless loop guided volute passage driven scraping means for preventing build-up of workable material on a rotating heat transfer member. The heat transfer system includes a housing having an inlet for introducing workable material into a mixing chamber located within the housing. The housing further includes an outlet for discharging the workable material from the mixing chamber. At least one endless loop member is positioned within the housing for motion along an endless loop path having a portion extending adjacent the mixing chamber. Loop support means are connected to the housing and include at least two oppositely directed, outwardly curved surfaces for supporting the endless loop member.

A mixing member is rotatably mounted within the mixing chamber adjacent to at least a portion of the endless loop path. The rotatable mixing member includes at least one groove-shaped flute at its outer surface defining at least one volute passageway. The housing is in fluid communication with heat supply means for transferring heat to or from workable material in the mixing chamber. Scraper means having an outline corresponding to at least a portion of the cross-section of the volute passageway is connected with said endless loop member.

During operation, at least one endless loop member repetitively introduces the scraper means into contact with an upstream portion of the volute passageway; and, after movement of the scraper means to a downstream portion of the passageway while in scrubbing contact with and during rotation of the rotatable mixing, the endless loop member conveys the scraper means from the downstream portion to the upstream portion in order to initiate another cleaning cycle.

In a preferable arrangement of the present invention, at least first and second endless loop members are positioned in the housing in spaced planes and at least three bridging members each extend between corresponding portions of the first and second endless loop members such that each bridging member moves in a loop motion defined by the loop members. In addition, a separate scraper means is connected with the first and second endless loop members via each bridging member. In the preferred embodiment, the three bridging members are preferably evenly spaced from one another to ensure that at least one scraping means is always in contact with a volute passageway. In such a structure, the rotating mixing member actually powers the endless loop by transporting the scraper means between upstream and downstream portions. However, it is considered within the scope of the present invention to drive the endless loop member by any conventional power source such as an electric motor or the like. The invention is also believed to reside in other various details of the preferred apparatus and method which are described in the drawings and in the text which follows.

BRIEF DESCRIPTION OF THE DRAWINGS

The present invention will now be described in more detail in the following portions of this specification with reference to the accompanying drawings, wherein:

FIG. 3 shows a blown-up elevational view in the direction of arrows 3—3 and in partial cross-section illustrating a portion of the scraping assembly employed in the embodiment of FIGS. 1A and 1B;

FIG. 4A is a bottom view of the bearing structure of FIG. 4B as seen looking upward toward a shim for tightening the supporting cable, the cable ends being shown in section.

FIG. 4B is an elevational end view of the support bearing structure employed for rotatably attaching each bridging member to a pair of separate cable end portions;

FIG. 5 shows an exploded view of the support bearing structure and pulley scraper assembly of the present invention; and, FIG. 6 shows a perspective view of the scraping assembly employed in the embodiment of FIGS. 1A and 1B.

BEST MODE FOR CARRYING OUT THE INVENTION

Figure 1A:
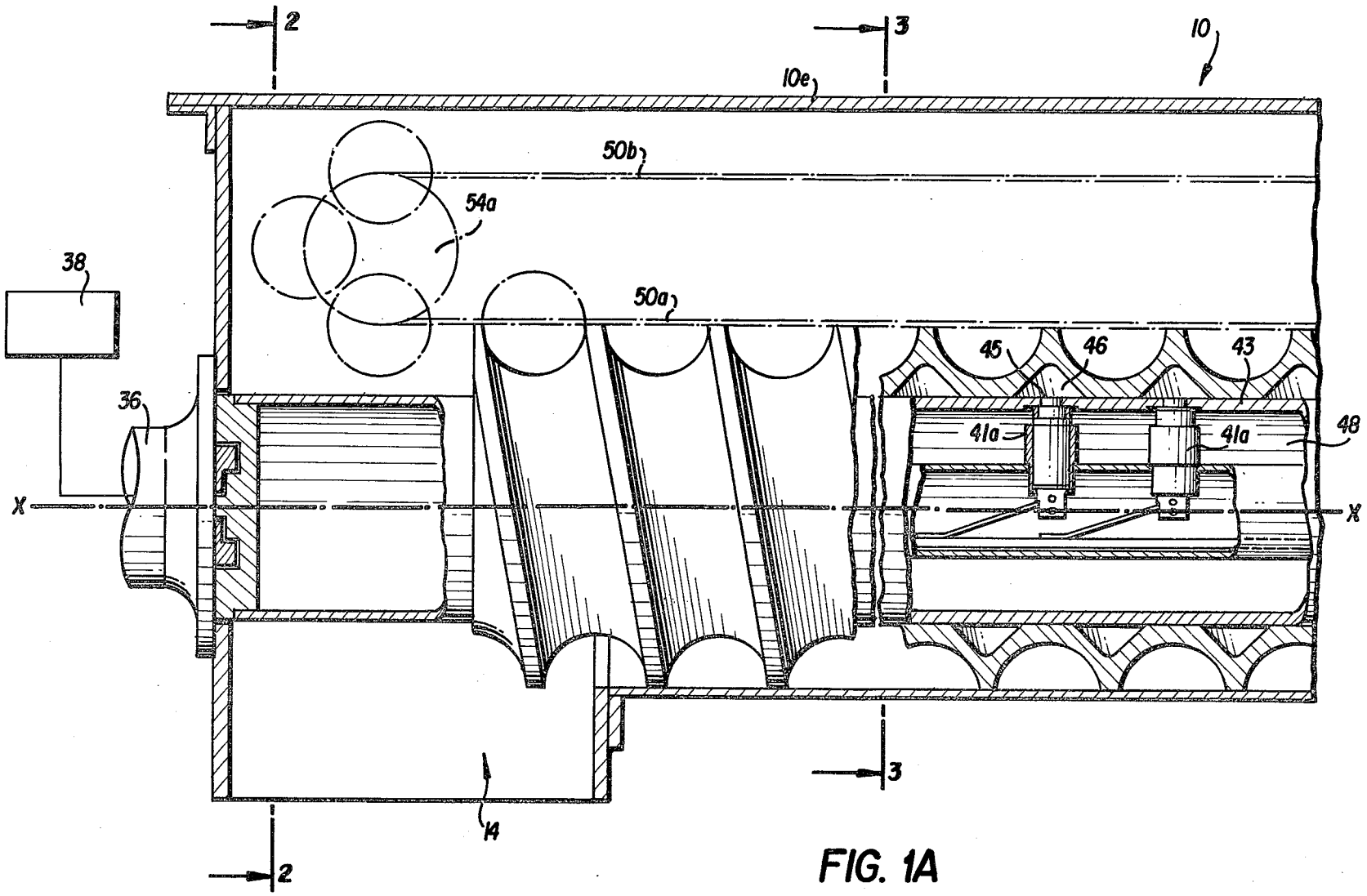
FIGS. 1A and 1B taken end-to-end show a cross-sectional side view of a heating and/or drying device formed in accordance with the present invention.
Figure 1B:
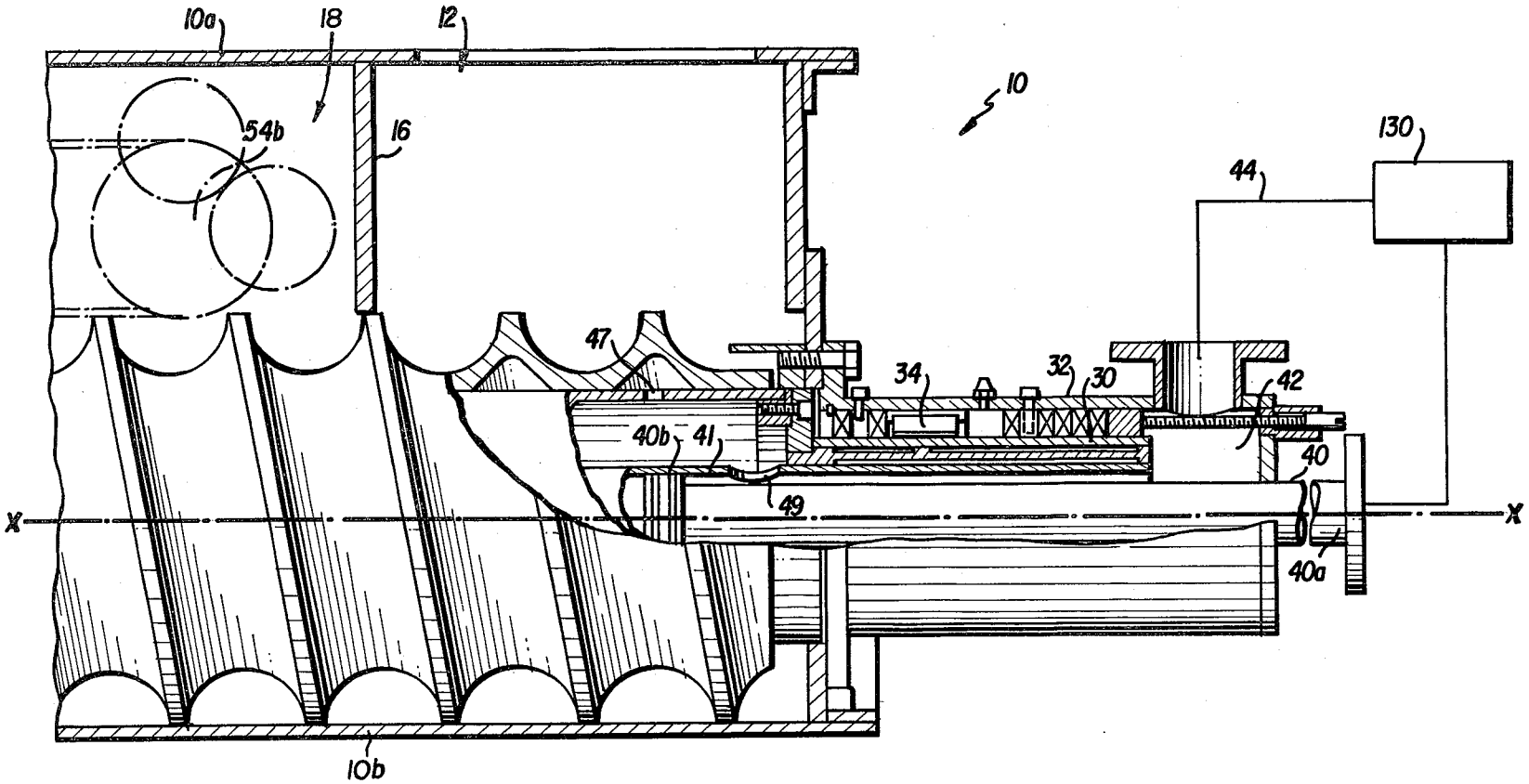

One embodiment of the invention, as represented by FIGS. 1A and 1B comprises a hollow, elongated housing 10 having a material inlet 12 extending through a vertically upper wall **10*a* of housing 10 with inlet 12 located at an upstream end portion of housing 10. Likewise, a material outlet 14 is located at the downstream end of housing 10 and extends through the bottom of housing 10. During operation, a workable material is introduced into housing 10 via upstream inlet 12 and later discharged from housing 10 via downstream outlet 14. In addition, a guide plate 16 extending transversely to longitudinal axis X—X through housing 10 projects into the hollow housing from a portion of upper wall 10*a* positioned adjacent to inlet 12 and functions to direct workable material downwardly into contact with at least one, and preferably a pair of rotatable mixing members 20 and 22**.

Top and bottom walls **10*a* and 10*b* of housing 10 along with a pair of spaced sidewalls 10*c* and 10*d* define a chamber 18 extending between inlet and outlet portions 12 and 14, respectively. The pair of mixing members 20 and 22 are each rotatably disposed in chamber 18. Each mixing member preferably takes the shape of a helical screw extending substantially parallel to the longitudinal axis X—X through housing 10. In particular, each mixing member includes at least one flute 24 or 26, respectively, with each flute extending from the upstream end portion of housing 10 adjacent inlet 12 to the downstream end portion adjacent outlet 14. Each flute 24, 26 defines at least one volute passageway preferably, though not necessarily having a cross-section of substantially semi-circular configuration. Because each of the mixing members 20 and 22 are essentially of similar construction, a detailed description of mixing member 20 is believed sufficient for a proper understanding of the remaining mixing member 22**.

Figure 2:
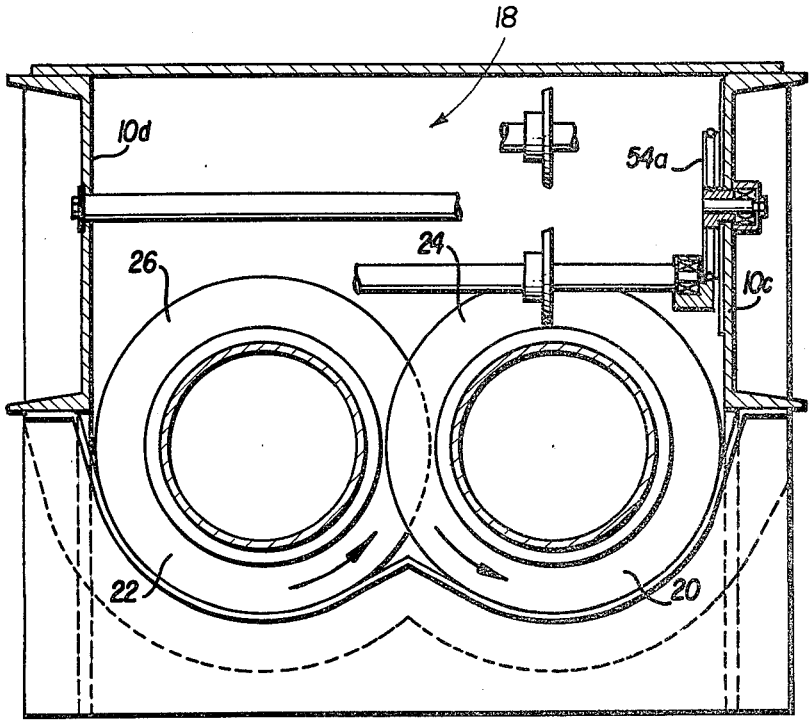
FIG. 2 shows a cross-sectional end view of FIG. 1A taken along line 2—2.

Mixing member 20 (referred to hereafter as helical mixing screw 20) includes an upstream end portion 30 rotatably journalled within a surrounding upstream end 32 of housing 10 via conventional bearings 34. A further, downstream end portion 36 of helical mixing screw 20 projects through an opening in an end wall of housing 10 and is conveniently attached to a source of rotative power, schematically shown at 38. Upon selective activation of drive source 38, attached helical mixing screw 20 is caused to rotate in a direction which would advance a scraper located in flute 24 from the upstream inlet 12 toward the downstream outlet 14 of housing 10. In particular, drive source 38 would rotate helical mixing screw 20 in a counter-clockwise direction as shown in FIG. 2. Of course, if the pitch of flute 24 were opposite in direction to that shown in FIGS. 1 and 2, drive source 38 should operate to rotate helical mixing screw 20 in a clockwise direction. While drive source 38 is shown as being attached to a downstream end of helical mixing screw 20, it would be equally possible to attach drive source 38 to the upstream end portion 30 of mixing screw 20.

A non-rotating heat transfer supply tube 40 has an end portion **40*a* in fluid communication with a source of heat transfer fluid, such as the boiler schematically represented at 130. Supply tube 40 projects into an end portion of a distributing tube 41 which extends through and is mounted for joint rotation with helical mixing screw 20. A piston-like sealing gland 40*b* is mounted on an end of supply tube 40 remote from end portion 40*a*, with sealing gland 40*b* contacting and forming a fluid-tight seal with a surrounding inner surface portion of distributing tube 41. An end of distributing tube 41 remotely positioned from supply tube 40 is sealed to prevent leakage of fluid from distributing tube 41. Surrounding and radially spaced from flow distributing tube 41 is helical mixing screw 20. As shown in FIG. 1, helical mixing screw 20 includes convoluted outer flute 24 surrounding and contacting a cylindrically-shaped inner tube 43 which surrounds distributing tube 41**.

A plurality of separate transfer glands **41*a* are each mounted on distributing tube 41, with each gland 41*a* preferably aligned with a separate aperture 45 extending through inner tube 43. Each gland 41*a* forms a through passageway from distributing tube 41 into a helical passage 46 defined between convoluted outer flute 24 and inner tube 43. Fluid entering helical passage 46 flows in a generally axial direction towards either or both ends of helical mixing screw 20 as required for the particular requirements of the workable materials being processed. One or more apertures 47 extend through predetermined portions of inner tube 43 to allow fluid to flow from helical passage 46 into an internal cavity 48 formed between inner tube 43 and distributing tube 41. Fluid is discharged from cavity 48 through one or more apertures 49 formed through portions of distributing tube 41 positioned upstream of sealing gland 41***a*. Apertures 49 allow fluid to flow from cavity 48 into a channel 42 defined between distributing tube 41 and supply tube 40, with channel 42 connected to boiler 130 via external piping schematically indicated at 44.

During operation of the heat transfer system constructed according to the present invention, workable material introduced into chamber 18 via inlet 12 is directed into contact with helical mixing screws 20 and 22 through the presence of guiding plate 16 as well as the sidewalls of housing 10. Counter-clockwise rotation of each of the helical mixing screws 20 and 22 serves to mix and simultaneously convey the workable material from inlet 12 toward outlet 14. As noted in FIGS. 1A, 1B and 2, only a very slight clearance exists between curved bottom wall 10*b* and each of the helical mixing screws 20 and 22. Likewise, only a very slight clearance exists between the spaced sidewalls 10*c* and 10*d* and the respective helical mixing screws, thereby ensuring that the workable material remains in close mixing contact with the outer fluid surfaces 24, 26 of the helical mixing screws as the workable material travels between inlet 12 and outlet 14.

At the same time that rotation of the helical mixing screws 20 and 22 mixes and conveys the workable material from inlet 12 to outlet 14, heat transfer fluid is introduced into the helical passage formed on each mixing screw from external source 130 via the internal passageways as discussed hereabove. Heat is transferred through the screw members to the workable material via conductive, convective and even radiant heat transfer as the workable material is mixed by contact with rotating helical screws 20 and 22. This provides for substantially uniform heating of the workable material and evaporation of volatile matter present. As the volatile matter evaporates, it is vented from chamber 18 via conventional exhaust port means such as opening 10*e* formed through wall 10*b* of housing 10.

The following portion of the description will be directed to the endless loop supported scraper assembly mounted in housing 10 for preventing the build-up of deposits of workable material on exterior surfaces of the helical mixing screws 20 and 22.

Referring now to FIGS. 2, 3 and 5, at least one endless loop member is shown as being mounted within housing 10. Preferably a pair of endless loop members 50 and 52 are each mounted for movement in a separate plane extending along sidewalls 10*c* and 10*d*, respectively, of housing 10. Each of the endless loop members 50 and 52 is preferably constructed of a plurality of separate sections of cable wire joined end-to-end to form a continuous loop in a manner to be described. Alternatively, and less preferably, each of the loop members could be formed of a single piece of cable wire joined end-to-end to form a closed loop.

Each of the endless loop members is supported on a separate loop support means attached to one of the sidewalls 10*c* or 10*d* of housing 10. Each loop support means includes at least two outwardly curved surfaces facing away from one another for supporting said loop members in separate planes. Preferably, each loop support means includes a pair of rotatable sheaves mounted on each wall and spaced adjacent member 16 and outlet 14, respectively. In particular, a pair of sheaves 54*a* and 54*b* are rotatably attached to wall 10*c*, while a similar pair of sheaves are rotatably attached to wall 10*d*, with only sheaves 54*a* and 56*a* shown in FIG. 6. Each sheave includes a groove, similar to the groove 55 formed in sheave 54*a* as shown in FIG. 5, for supporting one of the endless loop members 50 and 52.

The sheaves may be formed of solid material, or preferably they may include radially outwardly extending ribs defining circumferential side openings extending through the sheaves to allow workable material to pass therethrough.

Figure 6:
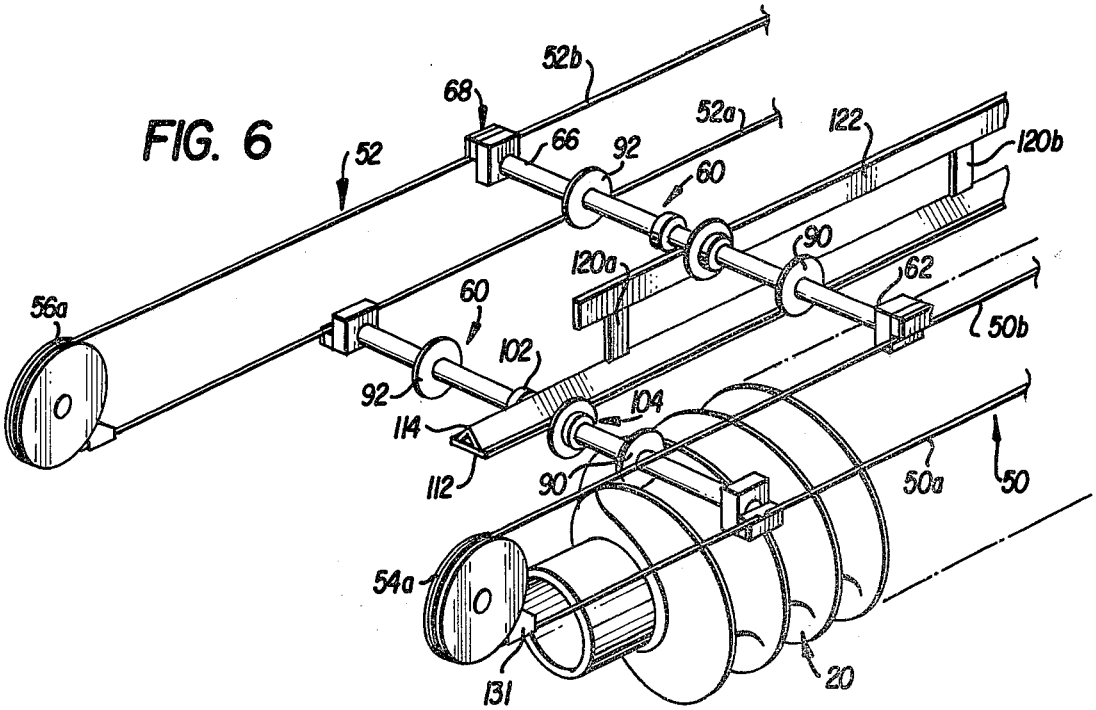

Each loop support means may take the form of a single, elongated support member having oppositely disposed end surfaces outwardly curved to support an endless loop in a manner similar to the pair of sheaves 54*a* and 54*b*. Whether each loop support means comprises a single support member or a pair of separate wheel-shaped sheaves, the spacing between the oppositely disposed outwardly curved surfaces ensures that side portions of each endless loop extend substantially parallel to one another. As shown in FIG. 6, endless loop 50 includes opposite side portions 50*a* and 50*b* which extend substantially parallel to one another. The same construction holds true for the opposite side portions 52*a* and 52*b* of endless loop 52. Furthermore, as best shown in FIGS. 1 and 6, sheaves 54*a* and 54*b* are positioned slightly vertically above the helical mixing screws 20 and 22. This ensures that at least a portion of the path of travel of each endless loop members 50 and 52 surrounding sheaves 54*a* and 54*b* and 56*a* and 56*b* is adjacent a portion of a volute passageway formed by either flute 24 or 26, respectively.

In a preferred embodiment of the present invention, at least one bridging member 60 extends between and is rotatably attached at opposite ends to each of the endless loop members 50 and 52. Bridging member 60 comprises an elongated shaft having a first end portion 62 rotatably journalled in a bearing block assembly 64, and bridging member 60 includes a second end portion 66 rotatably journalled in a further bearing block assembly 68. Because the bearing block assemblies are essentially of identical construction to one another, a description of bearing block assembly 64 as shown in detail in FIGS. 4A, 4B and 5 is considered sufficient for a complete understanding of the remaining bearing block 68.

Bearing block assembly 64 includes a block housing 70 having a through bore sufficient in diameter to receive end portion 62, with bearing members 72 rotatably mounted in block housing 70 and supporting end portion 62 in order to provide free rotation of bridging member 60 relative to block housing 70. A pair of grooved flange members 74*a* and 74*b* extend outwardly from a side of block housing 70 facing away from bridging member 60, with each flange member having a groove 76*a* or 76*b*, respectively, extending parallel to a longitudinal axis through endless loop side portion 50*a*. The grooved flange members 74*a* and 74*b* are spaced from one another a distance sufficient to allow a pair of separate cable end portions 80*a* and 80*b* to be disposed in side-by-side relationship therebetween.

Overlapping grooved-flange members 74*a* and 74*b* is a clamping member 82 which also overlaps cable end portions 80*a* and 80*b* disposed between flange members 74*a* and 74*b*. It is evident that this construction is adaptable for use with an endless loop member having separate cable end portions. However, a continuous cable can also be employed, with a continuous portion of the cable attached to grooved flanges 74*a* and 74*b*, rather than separate end portions 80*a* and 80*b*.

During assembly, each cable end 80*a* and 80*b* extends in a substantially vertical direction between the flanges 74*a* and 74*b*, respectively. The clamping member 82 is then positioned so as to overlap portions of flanges 74*a* and 74*b* and is rigidly thereto attached via conventional screw fasteners or the like. This clamps the end portions 80*a* and 80*b* into fixed engagement with block housing 70 to form an endless loop while at the same time attaching bridging member 60 to the endless loop 50 via block housing 70. It is pointed out that a longitudinal axis through bridging member 60 should intersect an extension of the longitudinal axis through endless cable member 50 to eliminate any moments from occurring. In addition, the longitudinal axis of bridging member 60 preferably should also bisect the vertical median line between the cable end portions 80*a* and 80*b* when properly assembled to provide for a properly balanced assembly. However, it is also considered within the scope of the present invention to have the longitudinal axis of bridging member 60 off-set slightly from the longitudinal axis of endless cable member 50.

As best shown in FIG. 6, a pair of separate scraper means 90 and 92 are mounted on each of the bridging members 60. Each scraper means 90 and 92 has an outline corresponding to at least a portion of the cross-section of one of the volute passageways formed by either flute 24 or flute 26, respectively. This construction ensures that each scraper means is capable of scraping the respective volute passageway as the scraper means moves from an upstream end of its respective flute to a downstream end.

As best shown in FIG. 3, scraper means 90 includes a hub portion 94 surrounding and fixedly attached to bridging member 60 via a conventional screw fastener 95. Integrally attached to hub portion 94 is a disk-shaped portion 96 extending radially outwardly from bridging member 60. Disk-shaped portion 96 includes a circumferentially extending outer surface 98 slightly inclined toward hub portion 94. This construction provides an acute edge 100 for contacting the volute passageway formed by flute 24. Scraper means 90 is positioned on bridging member 60 such that a planar side of the disk-shaped portion 96 facing away from hub portion 94 coincides with a vertical plane Z—Z including the longitudinal axis X—X of helical mixing screw 20. In other words, acute edge 100 contacts the volute passage at its vertically uppermost location. Furthermore, because helical mixing screw 20 rotates in a counter-clockwise direction, scraper means 90 is positioned on the counter-clockwise side of plane Z—Z.

During operation, rotation of helical mixing screw 20 continuously brings additional downstream portions of the volute passageway formed by flute 24 into scraping contact with acute edge 100.

It is respectfully noted that scraper means 92 is similar in construction to scraper means 90 and is mounted above and on the counter-clockwise side of a vertical plane including the longitudinal axis through helical screw member 22. As a result, scraper means 90 and 92 act to continuously and simultaneously clean both the helical mixing screws 20 and 22. Furthermore, each of the at least three bridging members employed in the preferred embodiment supports a pair of scraper means 90 and 92, with at least one pair of scraper means always in contact with a portion of the volute passageways formed by flutes 24 and 26. This allows rotation of the mixing member 20 and 22 to provide the entire force necessary for moving the bridge mounted scraper means between upstream and downstream ends of the mixing members, while simultaneously recirculating at least two bridging members to the upstream end to begin a new cleaning cycle.

Because each of the bridging members 60 is rotatably mounted within a pair of support block assemblies 64 and 68, the bridging member along with the pair of scraper means mounted thereon can rotate about the longitudinal axis through the respective bridging member. This ensures that new portions of acute edge 100 are continuously brought into contact with either flute 24 or 26. This, in turn, promotes even wear about the entire circumference of the disk-shaped portion 98 during scraping engagement. Furthermore, because only acute edge 100 actually contacts either flute 24 or 26, the friction generated between the scraper means 90, 92 and the helical mixing screws 20 and 22 is kept to an absolute minimum. Furthermore, contact between edge 100 and flute 24 results in wear of screw volute passage to a radius matching scraper edge 100.

Referring once again to FIGS. 3 and 6, an assembly is shown for withstanding thrust forces acting on scraper means 90 and 92 while maintaining the scraper means in their proper scraping positions relative to helical screw members 20 and 22. In particular, each bridging member 60 further includes hub members 102 and 104 each surrounding and fixedly attached to bridging member 60, with hub member 104 positioned between hub member 102 and scraper means 90. Hub member 104 includes an enlarged disk-shaped flange portion 106 extending in a radially outwardly direction from bridging member 60 and having a planar side 108 facing a planar side 110 of hub 102. A rectangularly-shaped thrust bar 112 rests on bridging member 60 and has a pair of opposite sides engaging planar sides 108 and 110. A channel 114 of inverted V cross-sectional configuration is fixedly mounted on thrust bar 112, such that thrust bar 112 and channel 114 both act to resist thrust forces transmitted from counter-clockwise rotating members 20 and 22 to the scraper means 90 and 92, respectively. Because each of the helical mixing screws preferably rotates in the same direction, all of the thrust forces tend to act in the same direction, namely along bridging member 60 in the direction of bearing block assembly 68. However, the combination of thrust bar 112 and inverted channel 114 mounted between hubs 102 and 104 creates a balance beam capable of successfully resisting these thrust forces. Furthermore, side 108 has an enlarged face as compared to side 110 in order to resist wear from normal rotation. In addition, if either helical screw 20 or 22 were temporarily rotated in an opposite, clockwise direction, the smaller face 110 of hub 102 provides a positive stop for transverse movement of bridging member 60 due to reversed contact between the scraping means 90, 92 and the flutes 24, 26. Furthermore, because thrust plate 112 and channel 114 extend between upstream and downstream end portions of each helical mixing screw, they act to align the various bridging members as they follow their loop-shaped course through mixing chamber 18.

A plurality of vertically extending support bars 120*a*, 120*b*, etc. each have a lower edge attached to a vertical upper edge of channel 114. Each support bar 120*a*, 120*b* also has an upper edge attached to a rectangularly-shaped support beam 122 extending parallel to thrust bar 112. Support beam 122 functions to support each bridging member 60 as it is returned from the downstream ends of helical mixing screws 20 and 22 toward the upstream ends. Support beam 122 in combination with thrust bar 112 and channel 114 also functions to vertically separate the various bridging members 60 a distance sufficient to allow the bridging members and attached scraper means 90 and 92 to vertically pass one another as they follow their loop-shaped course of movement.

As shown in FIG. 3, thrust bar 112, channel member 114 and support beam 122 may be attached to a rod 124 extending from wall 10*c* of housing 10, with rod 124 including a substantially V-shaped bottom portion fixedly attached to channel 114. While a single rod 124 is shown in FIG. 3, a plurality of similarly shaped rods 124 may be employed for supporting thrust bar 112 and support beam 122 in predetermined positions such that scraper means 90 and 92 just contact flutes 24 and 26. While a plurality of rods similar to rod 124 may be employed, it is also considered within the scope of the present invention to provide any convenient structure for supporting thrust bar 112 and support beam 122. For example, bridging members 60 could be arranged such that two bridging members are at all times positioned beneath and in contact with thrust bar 112, whereby bridging members 60 provide the sole support for thrust bar 112 and the structure mounted thereon.

As shown in FIGS. 5 and 6, a separate scraper block assembly 131 is mounted at a downstream end of each helical mixing screw, such that a cleaning edge 132 formed on each scraper block 131 projects into a portion of the groove 55 formed in one of the sheaves 54*a* and 56*a*, respectively. Each cleaning edge 132 functions to clean its respective sheave of workable material tending to clog the sheave. Furthermore, each scraper block 131 includes a substantially U-shaped slot partially surrounding one of the endless loop members so as to clean workable material from the loop member itself as it travels therethrough. The scraper block assemblies 131 need only be mounted at the downstream ends of the endless loop members in order to effectively clean the cable sections employed in the endless loop.

While the preferred embodiment of the present invention employs at least three separate bridging members, there is no theoretical upper limit to the number of bridging members which may be employed depending on the length of the helical screw members to be cleaned. Furthermore, as stated herebefore, if the endless loop members are powered by a source of power separate from the rotating screw members, it is also possible to employ only a single bridging member with a single pair of scraper means mounted thereon. Likewise, scraper means 90 and 92 need not be mounted on a common bridging member 60, rather, each scraper means may be supported by a separate bridging member. Finally, while a pair of loop-shaped members are preferably employed for supporting and moving each scraper means, it is within the scope of the present invention for each scraper means to be attached to a single loop-shaped member via a connecting assembly.

The present invention is not to be limited to the embodiments as examplified hereabove, rather, the present invention is only to be defined by the scope of the claims following hereafter.

What is claimed is:

1. Heat transfer apparatus with endless loop guided volute passage scraping means, comprising:

a housing including an inlet for introducing workable material into said housing and further including an outlet for discharge of said workable material from said housing;

at least first and second endless loop members positioned in spaced planes extending in said housing;

loop support means connected with said housing and including at least two oppositely and outwardly curved surfaces for supporting each of said first and second endless loop members in its respective plane;

at least one bridging member extending between and attached to corresponding portions of said first and second endless loops for causing said bridging member to move in a loop path defined by motion of said endless loop members;

a mixing member mounted for rotation in said housing adjacent at least a portion of the loop path traversed by said bridging member, said mixing member including at least one flute at its outer surface defining at least one volute passageway;

means mounted in said housing for transferring heat to or from said workable material;

scraper means having an outline corresponding to at least a portion of the cross-section of said volute passageway and connected with said first and second endless loop members through said bridging member for scrapingly contacting and cleaning the walls of said volute passageway during rotation of said mixing member;

whereby said first and second endless loop members repetitively introduce said scraper means into contact with an upstream portion of said volute passageway and, after movement of said scraper means to a downstream portion of said passageway while in contact with and during rotation of said rotatable member, convey said scraper means from said downstream portion to said upstream portion.

2. Heat transfer apparatus according to claim 1, wherein each of said first and second endless loop members comprises a plurality of separate segments of metallic wire joined end-to-end to form a closed loop cable.

3. Heat transfer apparatus according to claim 1, wherein at least one of said first and second endless loop members comprises a single segment of metallic wire having a pair of opposite end portions joined together to form a closed loop cable.

4. Heat transfer apparatus according to claim 1, wherein said mixing member includes an axis of rotation located between said spaced planes including said first and second endless loop members.

5. Heat transfer apparatus according to claim 1, wherein said loop support means are positioned for maintaining each of said endless loop members in a shape having two parallel, substantially linear sides and a pair of curved end portions which contact said outwardly curved surfaces of said loop support means.

6. Heat transfer apparatus according to claim 5, wherein said loop support means comprises a first pair of wheel-shaped members rotatably mounted on a first side wall of said housing, and said loop support means further comprising a second pair of wheel-shaped members rotatably mounted on a second, oppositely disposed side wall of said housing.

7. Heat transfer apparatus according to claim 5, wherein said loop support means comprises a first pair of pulleys rotatably mounted on a first side of said housing and a second pair of pulleys rotatably mounted on a second side of said housing.

8. Heat transfer apparatus according to claim 7, wherein said first and second pairs of pulleys each includes an upstream pulley positioned adjacent an upstream end of said housing and each of said first and second pairs of pulleys includes a downstream pulley positioned adjacent a downstream end of said housing.

9. Heat transfer apparatus according to claim 5, wherein said loop support means comprises a first pair of sheaves attached to a first wall of said housing and a second pair of sheaves attached to a second side wall of said housing, wherein each sheave included in said first pair is aligned with a separate sheave included in said second pair.

10. Heat transfer apparatus according to claim 4, wherein said at least one bridging member comprises an elongated shaft extending in a direction substantially perpendicular to the axis of rotation of said mixing member.

11. Heat transfer apparatus according to claim 10, wherein a pair of support block assemblies are attached to each of said first and second endless loop members, respectively;

said support block assemblies being aligned with one another and each support block assembly including an opening of sufficient size so as to receive an end portion of said at least one bridging member therein.

12. Heat transfer apparatus according to claim 11, wherein each support block assembly includes bearing means surrounding and contacting an end portion of said bridging member for rotatably supporting said bridging member, each support block assembly further includes clamping means for providing fixed engagement with one of said endless loop members.

13. Heat transfer apparatus according to claim 10, wherein said at least one bridging member further includes abutment means for resisting thrust forces acting in a direction parallel to a longitudinal axis through said bridging member.

14. Heat transfer apparatus according to claim 13, wherein said abutment means comprises a pair of abutment hub members each mounted on said bridging member with a rectangularly-shaped thrust bar extending between said hub members;

said abutment means further comprises a channel of inverted V-shaped configuration mounted on said thrust bar and extending substantially the entire distance between said hub members.

15. Heat transfer apparatus according to claim 14, wherein a plurality of separate elongated shaft bridging members extend between said first and second endless loop members, each elongated shaft having a pair of end portions rotatably journalled in a pair of bearing block assemblies fixedly attached to said endless loop members.

16. Heat transfer apparatus according to claim 15, wherein each elongated shaft bridging member includes a pair of abutment hubs fixedly attached thereto and spaced on opposite sides of said thrust bar.

17. Heat transfer apparatus according to claim 1 or 15, wherein said scraper means comprises a disk-shaped hub fixedly mounted on said bridging member for joint rotation therewith, said disk-shaped hub including a circumferentially extending outer edge surface contacting said mixing member to clean workable material from building up on said mixing member.

18. Heat transfer apparatus according to claim 17, wherein said edge portion of said disk-shaped hub is inclined toward said bridging member to form an acute angle with a planar face of said disk-shaped hub facing toward said mixing member.

19. Heat transfer apparatus according to claim 1, wherein said mixing member comprises a hollow, substantially cylindrically-shaped member.

20. Heat transfer apparatus according to claim 19, wherein a pair of substantially cylindrically-shaped, hollow mixing members are rotatably mounted side-by-side within said housing.

21. Heat transfer apparatus according to claim 20, wherein each of said hollow mixing members has a helical screw configuration, with each hollow mixing member having at least one flute at its outer surface defining at least one volute passageway.

22. Heat transfer apparatus according to claim 21, wherein said at least one bridging member extends transversely to an axis of rotation of each mixing member and includes a pair of scraper means mounted thereon, whereby each scraper means has an outline corresponding to at least a portion of the cross-section of one of said volute passageways for scrapingly contacting and simultaneously cleaning the walls of each mixing member during rotation thereof.

23. Heat transfer apparatus according to claim 22, wherein at least three separate bridging members each extends transversely to the axis of rotation of said mixing members and are spaced from one another such that at least one scraper means is always in contact with one mixing member.

24. Heat transfer apparatus with endless loop guided volute passage driven scraping means, comprising:

a housing including an inlet for introducing workable material into said housing and further including an outlet for discharge of said workable material from said housing;

at least one endless loop member positioned in said housing for motion along a loop path;

loop support means connected with said housing and including at least two oppositely and outwardly curved surfaces for supporting said endless loop member;

a mixing member mounted for rotation in said housing adjacent at least a portion of said path and having at least one flute at its outer surface defining at least one volute passageway;

means mounted in said housing for transferring heat to or from said workable material; and scraper means having an outline corresponding to at least a portion of the cross-section of said volute passageway, said scraper means being connected with said endless loop member;

whereby said endless loop member repetitively introduces said scraper means into contact with an upstream portion of said volute passageway and, after movement of said scraper means to a downstream portion of said passageway while in contact with and during rotation of said rotatable member, conveys said scraper means from said downstream portion to said upstream portion.

25. A self-cleaning heat transfer apparatus for drying workable materials, said apparatus comprising:

a housing including an inlet for introducing workable material into said housing and further including an outlet positioned downstream of said inlet for removing said workable material from said housing;

at least one helical screw rotatably mounted within said housing, said helical screw having at least one flute defining at least one volute passageway;

means for heating said workable material present in said housing;

first and second separate pairs of pulley members rotatably attached to said housing and disposed on opposite sides of said at least one helical screw from one another;

a first endless cable assembly stretched between and partially encircling said first pair of pulleys and a second endless cable assembly stretched between and partially encircling said second pair of pulleys to facilitate reciprocal transport along said helical screw of a plurality of separate bridging members extending between and rotatably attached to aligned portions of said first and second endless cables, respectively; and, at least one disk-shaped scraper mounted on each bridging member, each scraper disk having a radially outer edge surface in continuous contact with said volute passageway of said helical screw as said attached bridging shaft moves in said downstream toward said outlet, thereby preventing and removing deposits from forming on said at least one helical screw.

* * * * *